US008065138B2

(12) United States Patent
Akagi et al.

(10) Patent No.: US 8,065,138 B2
(45) Date of Patent: Nov. 22, 2011

(54) SPEECH PROCESSING METHOD AND APPARATUS, STORAGE MEDIUM, AND SPEECH SYSTEM

(75) Inventors: Masato Akagi, Nomi (JP); Rieko Futonagane, Tokyo (JP); Yoshihiro Irie, Himeji (JP); Hisakazu Yanagiuchi, Himeji (JP); Yoshitane Tanaka, Himeji (JP)

(73) Assignees: Japan Advanced Institute of Science and Technology, Nomi-shi (JP); Glory Ltd., Himeji-shi (JP)

( * ) Notice: Subject to any disclaimer, the term of this patent is extended or adjusted under 35 U.S.C. 154(b) by 1117 days.

(21) Appl. No.: 11/849,106

(22) Filed: Aug. 31, 2007

(65) Prior Publication Data

US 2008/0281588 A1 Nov. 13, 2008

Related U.S. Application Data

(63) Continuation of application No. PCT/JP2006/303290, filed on Feb. 23, 2006.

(30) Foreign Application Priority Data

Mar. 1, 2005 (JP) ..... 2005-056342

(51) Int. Cl.
*G10L 19/04* (2006.01)

(52) U.S. Cl. ..... 704/205; 704/209; 704/220; 704/219; 704/267

(58) Field of Classification Search ..... 704/207, 704/205, 233, 209, 223, 267, 222, 219, 200.1, 704/500–504, 226–230, 263, 220
See application file for complete search history.

(56) References Cited

U.S. PATENT DOCUMENTS

| | | | | |
|---|---|---|---|---|
| 3,681,530 | A * | 8/1972 | Manley et al. | 704/203 |
| 4,827,516 | A * | 5/1989 | Tsukahara et al. | 704/224 |
| 5,749,065 | A * | 5/1998 | Nishiguchi et al. | 704/200.1 |
| 6,073,100 | A * | 6/2000 | Goodridge, Jr. | 704/258 |
| 6,115,684 | A * | 9/2000 | Kawahara et al. | 704/203 |
| 6,611,800 | B1 * | 8/2003 | Nishiguchi et al. | 704/221 |

(Continued)

FOREIGN PATENT DOCUMENTS

JP 5-22391 1/1993

(Continued)

OTHER PUBLICATIONS

Tesuro Saeki et al, "Selection of Meaningless Steady Nosie for Masking of Speech", the transactions of the Institute of Electronics, Information and Communication Engineers, J86-A, No. 2, Feb. 2003, pp. 187-191.

(Continued)

*Primary Examiner* — Vijay Chawan
(74) *Attorney, Agent, or Firm* — Oblon, Spivak, McClelland, Maier & Neustadt, L.L.P.

(57) ABSTRACT

A speech processing apparatus includes a spectrum envelope extracting unit which extracts the spectrum envelope of an input speech signal, a spectrum envelope deforming unit which applies deformation to the spectrum envelope to generate a deformed spectrum envelope, a spectrum fine structure extracting unit which extracts the spectrum fine structure of the input speech signal, a deformed spectrum generating unit which generates a deformed spectrum by combining the deformed spectrum envelope with the spectrum fine structure, and a speech generating unit which generates an output speech signal on the basis of the deformed spectrum. This apparatus emits a disrupting sound based on the output speech signal to prevent a third party from eavesdropping on a conversation.

16 Claims, 19 Drawing Sheets

U.S. PATENT DOCUMENTS

| | | | | |
|---|---|---|---|---|
| 6,826,526 | B1 * | 11/2004 | Norimatsu et al. | 704/222 |
| 6,904,404 | B1 * | 6/2005 | Norimatsu et al. | 704/222 |
| 6,925,116 | B2 * | 8/2005 | Liljeryd et al. | 375/240 |
| 7,243,061 | B2 * | 7/2007 | Norimatsu et al. | 704/205 |
| 7,283,955 | B2 * | 10/2007 | Liljeryd et al. | 704/219 |
| 7,451,082 | B2 * | 11/2008 | Gong et al. | 704/233 |
| 7,596,489 | B2 * | 9/2009 | Kovesi et al. | 704/219 |
| 7,599,835 | B2 * | 10/2009 | Moriya et al. | 704/226 |
| 7,720,679 | B2 * | 5/2010 | Ichikawa et al. | 704/233 |
| 2003/0187663 | A1 * | 10/2003 | Truman et al. | 704/500 |
| 2004/0078205 | A1 * | 4/2004 | Liljeryd et al. | 704/503 |

FOREIGN PATENT DOCUMENTS

| | | | |
|---|---|---|---|
| JP | 9-319389 | | 12/1997 |
| JP | 2000-3197 | | 1/2000 |
| JP | 2002-123298 | | 4/2002 |
| JP | 2002-215198 | | 7/2002 |
| JP | 2002-251199 | | 9/2002 |
| JP | 2003-514265 | | 4/2003 |
| JP | 2005-84645 | | 3/2005 |
| WO | WO 02/054732 | A1 | 7/2002 |
| WO | WO 2004/010627 | | 1/2004 |

OTHER PUBLICATIONS

Office Action issued on Jan. 18, 2011 in Japanese Patent Application No. 2005-056342 (with English Translation).

* cited by examiner

SPEECH PROCESSING METHOD AND APPARATUS, STORAGE MEDIUM, AND SPEECH SYSTEM

CROSS-REFERENCE TO RELATED APPLICATIONS

This is a Continuation Application of PCT Application No. PCT/JP2006/303290, filed Feb. 23, 2006, which was published under PCT Article 21(2) in Japanese.

This application is based upon and claims the benefit of priority from prior Japanese Patent Application No. 2005-056342, filed Mar. 1, 2005, the entire contents of which are incorporated herein by reference.

BACKGROUND OF THE INVENTION

1. Field of the Invention

The present invention relates to a speech system which prevents a third party from eavesdropping on the contents of a conversational speech and a speech processing method and apparatus and a storage medium which are used for the system.

2. Description of the Related Art

When people have a conversation in an open space or a non-soundproof room, the leakage of conversation may be a problem. Assume that a customer has a conversation with a bank clerk or an outpatient has a conversation with a receptionist or doctor in a hospital. In this case, if a third party overhears the conversation, it may violate secrecy or privacy.

Under the circumstances, there have been proposed techniques of preventing a third party from eavesdropping on a conversation by using a masking effect (see, for example, Tetsuro Saeki, Takeo Fujii, Shizuma Yamaguchi, and Kensei Oimatsu, "Selection of Meaningless Steady Noise for Masking of Speech", the transactions of the Institute of Electronics, Information and Communication Engineers, J86-A, 2, 187-191, 2003 and Jpn. Pat. Appln. KOKAI Publication No. 5-22391). The masking effect is a phenomenon in which when a person hearing a given sound hears another sound at a predetermined level or more, the original sound is canceled out, and the person cannot hear it. There is available, as a technique of preventing a third party from hearing an original sound by using such the masking effect, a method of superimposing pink noise or background music (BGM) as a masking sound on an original sound. As proposed by Tetsuro Saeki, Takeo Fujii, Shizuma Yamaguchi, and Kensei Oimatsu, "Selection of Meaningless Steady Noise for Masking of Speech", the transactions of the Institute of Electronics, Information and Communication Engineers, J86-A, 2, 187-191, 2003 band-limited pink noise is, in particular, regarded as most effective.

BRIEF SUMMARY OF THE INVENTION

In order to use a steadily produced sound such as pink noise or BGM as a masking sound, the masking sound needs to be higher in level than original speech. Therefore, a person who hears such a masking sound perceives the sound as a kind of noise, and hence it is difficult to use such a sound in a bank, hospital, or the like. On the other hand, decreasing the level of a masking sound will reduce the masking effect, leading to perception of an original sound in a frequency domain in which the masking effect is small, in particular. In addition, even if the level of a masking sound is properly adjusted, a person can hear a sound like pink noise or BGM while clearly discriminating it from an original sound. For this reason, due to the auditory characteristics of a human who can catch only a specific sound among a plurality of kinds of sounds, i.e., the cocktail party effect, a third party may hear an original sound.

It is an object of the present invention to prevent a third party from perceiving the contents of a conversational speech without annoying surrounding people.

In order to solve the above problems, according to an aspect of the present invention, the spectrum envelope and spectrum fine structure of an input speech signal are extracted, a deformed spectrum envelope is generated by deforming the spectrum envelope, a deformed spectrum is generated by combining the deformed spectrum envelope with the spectrum fine structure, and an output speech signal is generated on the basis of the deformed spectrum.

According to another aspect of the present invention, a high-frequency component of the spectrum of an input speech signal is extracted, a high-frequency component contained in a deformed spectrum is replaced by the extracted high-frequency component, and an output speech signal is generated on the basis of the deformed spectrum whose high-frequency component has been replaced.

DETAILED DESCRIPTION OF THE INVENTION

The embodiments of the present invention will be described below with reference to the views of the accompanying drawing.

Figure 1:
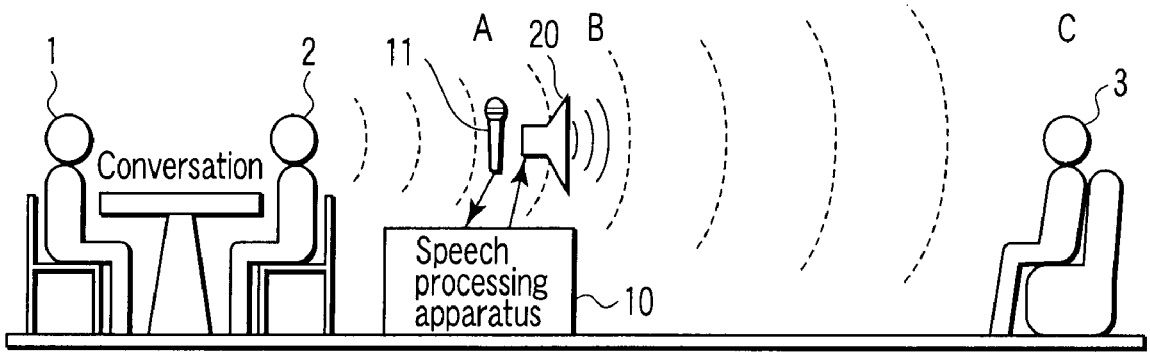
FIG. 1 is a view schematically showing a speech system according to an embodiment of the present invention.

FIG. 1 is a conceptual view of a speech system including a speech processing apparatus 10 according to an embodiment of the present invention. The speech processing apparatus 10 generates an output speech signal by processing the input speech signal obtained by capturing conversational speech through a microphone 11 placed at a position A near a place where a plurality of persons 1 and 2 in FIG. 1 are having a conversation. The output speech signal outputted from the speech processing apparatus 10 is supplied to a loudspeaker 20 placed at a position B to emit a sound from the loudspeaker 20.

In this case, if the phonemic characteristics of the output speech signal are destroyed while the sound source information of the input speech signal is maintained, fusing the sound emitted from the loudspeaker 20 with the sound of conversational speech can prevent a person 3 located at a position C from eavesdropping on the conversational speech between the persons 1 and 2. The sound emitted from the loudspeaker 20 has a purpose of preventing a third party from eavesdropping on a conversational speech in this manner, and hence will be referred to as a disrupting sound hereinafter. In other words, since the sound emitted from the loudspeaker 20 has a purpose of preventing a third party from eavesdropping on a conversational speech, the sound may also be referred to as an "anti-eavesdropping sound".

Figure 2A:
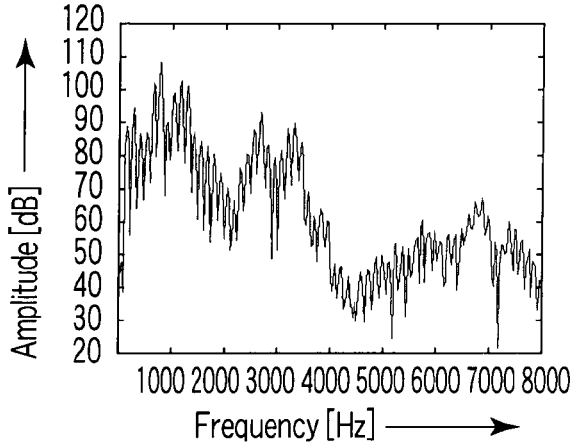
FIG. 2A is a graph showing an example of the spectrum of conversational speech captured by a microphone in the speech system in FIG. 1.
Figure 2B:
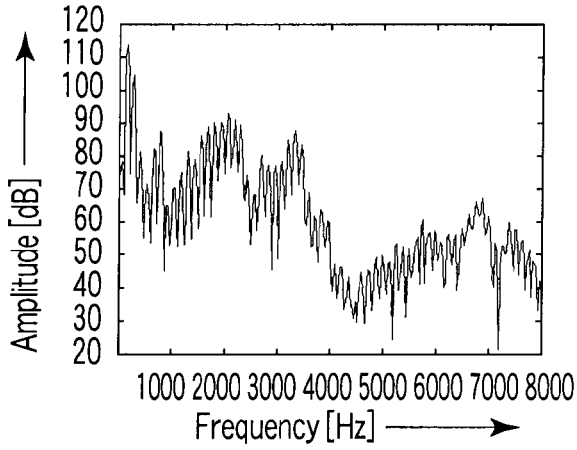
FIG. 2B is a graph showing the spectrum of a disrupting sound emitted from a loudspeaker in the speech system in FIG. 1.
Figure 2C:
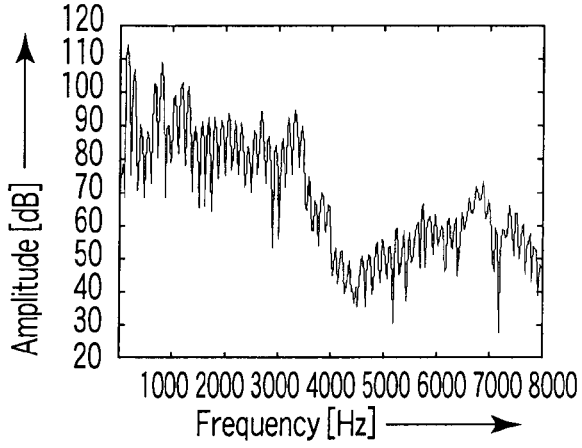
FIG. 2C is a graph showing an example of a fused sound of a disrupting sound and conversational speech in the speech system in FIG. 1.

The speech processing apparatus 10 performs processing for an input speech signal to generate an output speech signal whose phonemic characteristics are destroyed while the sound source information of the input speech signal is maintained. In accordance with this output speech signal, the loudspeaker 20 emits a disrupting sound whose phonemic characteristics have been destroyed. For example, if conversational speech captured by the microphone 11 has a spectrum like that shown in FIG. 2A, a disrupting sound emitted from the loudspeaker 20 through the speech processing apparatus 10 has a spectrum like that shown in FIG. 2B. In this case, at a position C in FIG. 1, a third party hears a sound having a spectrum like that shown in FIG. 2C, which is the spectrum of a fused sound of the disrupting sound and the direct sound of the conversational speech.

An embodiment of the speech processing apparatus 10 will be described in detail next.

First Embodiment

Figure 3:
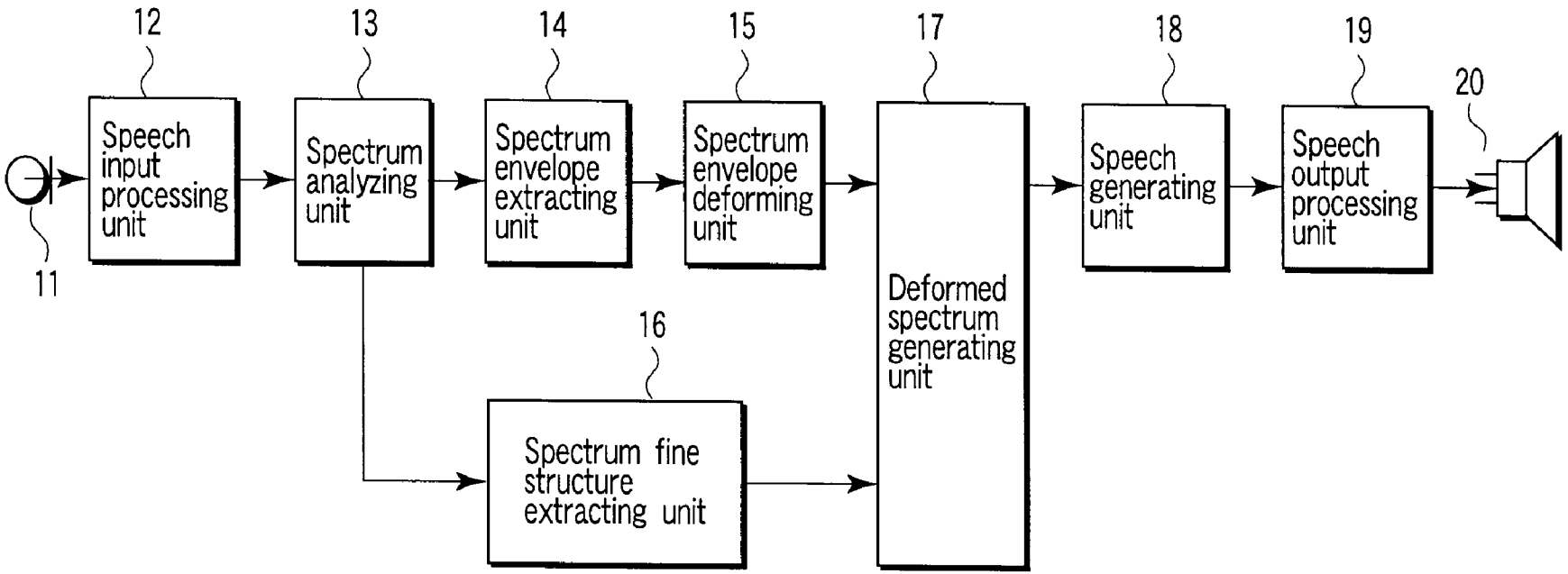
FIG. 3 is a block diagram showing the arrangement of a speech processing apparatus according to the first embodiment of the present invention.

FIG. 3 shows the arrangement of a speech processing apparatus according to the first embodiment. A microphone 11 is placed, for example, near a counter of a bank or at the outpatient reception desk of a hospital. This microphone captures conversational speech and outputs a speech signal. A speech input processing unit 12 receives the speech signal from the microphone 11. The speech input processing unit 12 includes, for example, an amplifier and an analog-to-digital converter. This unit amplifies a speech signal from the microphone 11 (to be referred to as an input speech signal hereinafter), digitalizes the signal, and outputs the resultant signal. A spectrum analyzing unit 13 receives the digital input speech signal from the speech input processing unit 12. The spectrum analyzing unit 13 performs FFT cepstrum analysis and analyzes the input speech signal by processing using a speech analysis synthesizing system based on the vocoder scheme.

Figure 4:
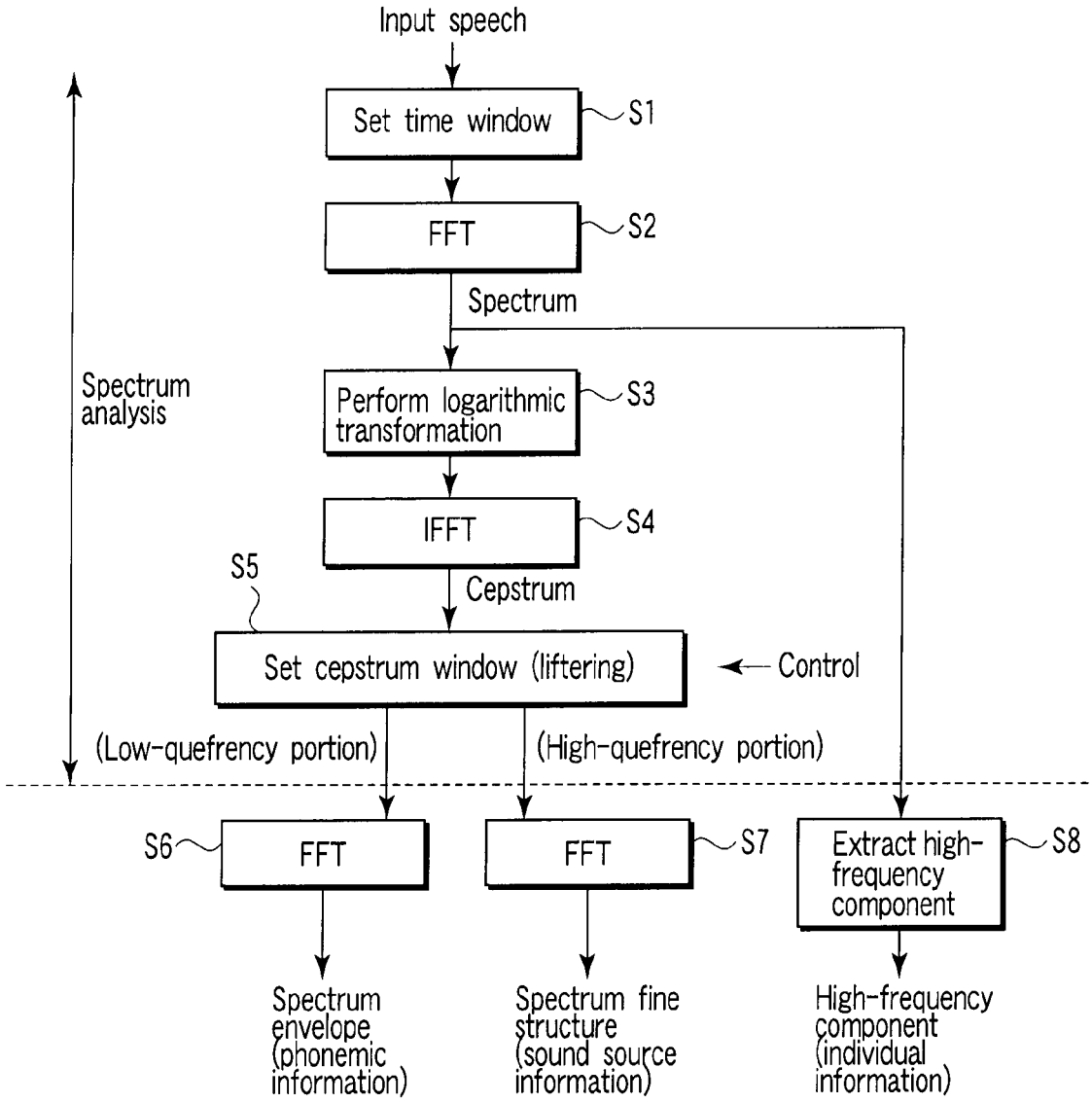
FIG. 4 is a flowchart showing an example of spectrum analysis and processing accompanying spectrum analysis.

A spectrum analysis procedure using cepstrum analysis for the spectrum analyzing unit 13 will be described with reference to FIG. 4. First of all, the spectrum analyzing unit 13 multiplies a digital input speech signal by a time window such as a Hanning window or Hamming window, and then performs short-time spectrum analysis using fast Fourier transform (FFT) (steps S1 and S2). This unit calculates the logarithm of the absolute value (amplitude spectrum) of the FFT result (step S3), and also obtains a cepstrum coefficient by performing inverse FFT (IFFT) (step S4). The unit then performs liftering for the cepstrum coefficient by using a cepstrum window and outputs low and high frequency portions as analysis results (step S5).

Figure 5A:
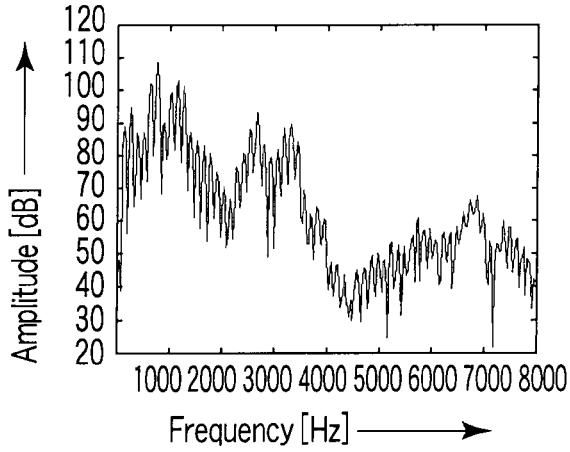
FIG. 5A is a graph showing an example of the speech spectrum of an input speech signal.
Figure 5B:
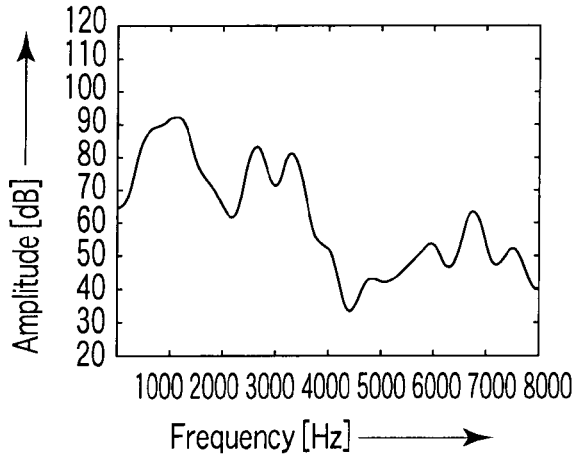
FIG. 5B is a graph showing an example of the spectrum envelope of the speech spectrum in FIG. 5A.

A spectrum envelope extracting unit 14 receives the low-frequency portion of the cepstrum coefficient obtained as the analysis result by the spectrum analyzing unit 13. A spectrum fine structure extracting unit 16 receives the high-frequency portion of the cepstrum coefficient. The spectrum envelope extracting unit 14 extracts the spectrum envelope of the speech spectrum of the input speech signal. The spectrum envelope represents the phonemic information of the input speech signal. If, for example, the input speech signal has the speech spectrum shown in FIG. 5A, the spectrum envelope is the one shown in FIG. 5B. The spectrum envelope extracting unit extracts a spectrum envelope by performing FFT (step S6) for the low-frequency portion of the cepstrum coefficient, as shown in, for example, FIG. 4.

Figure 5C:
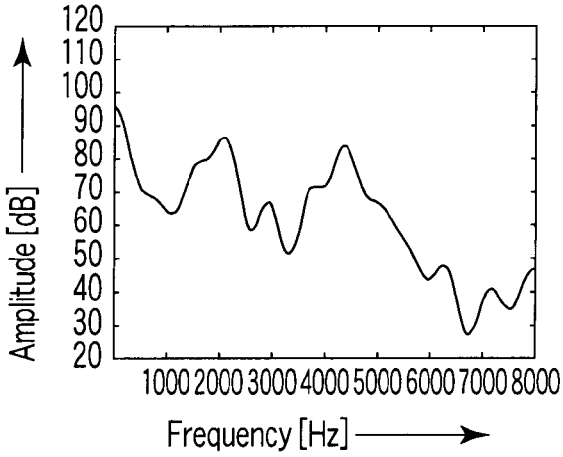
FIG. 5C is a graph showing an example of a deformed spectrum envelope obtained by deforming the spectrum envelope in FIG. 5B.

A spectrum envelope deforming unit 15 generates a deformed spectrum envelope by deforming the extracted spectrum envelope. If the extracted spectrum envelope is the one shown in FIG. 5B, the spectrum envelope deforming unit 15 deforms the spectrum envelope by inverting the spectrum envelope as shown in FIG. 5C. If, for example, FFT cepstrum analysis is used for the spectrum analyzing unit 13, a spectrum envelope is expressed by a low-order cepstrum coefficient. The spectrum envelope deforming unit 15 performs sign inversion with respect to such a low-order cepstrum coefficient. A more specific example of the spectrum envelope deforming unit 15 will be described in detail later.

Figure 5D:
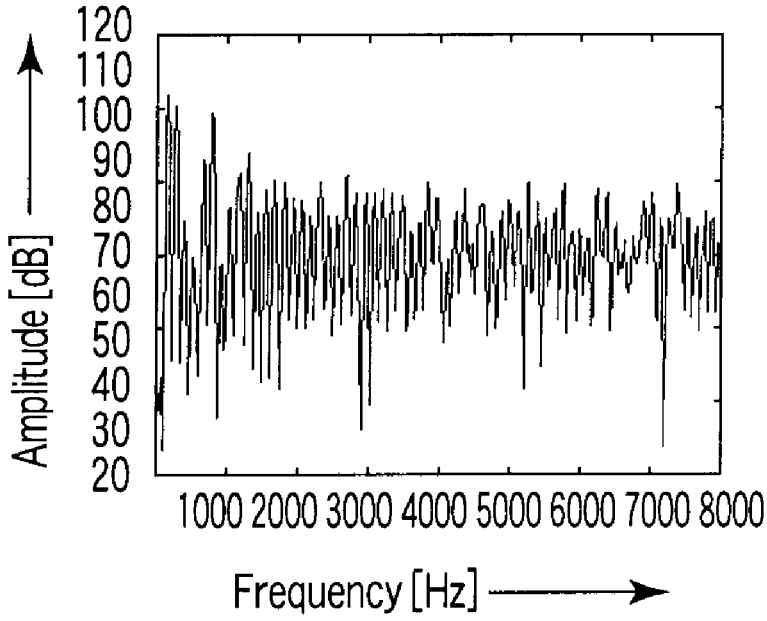
FIG. 5D is a graph showing an example of the spectrum fine structure of the speech spectrum in FIG. 5A.

The spectrum fine structure extracting unit 16 extracts the spectrum fine structure of the speech spectrum of the input speech signal. The spectrum fine structure represents the sound source information of the input speech signal. If, for example, the input speech signal has the speech spectrum shown in FIG. 5A, the spectrum fine structure is the one shown in FIG. 5D. The spectrum fine structure extracting unit extracts a spectrum fine structure by performing FFT (step S7) for the high-frequency portion of the cepstrum coefficient as shown in FIG. 4.

Figure 5E:
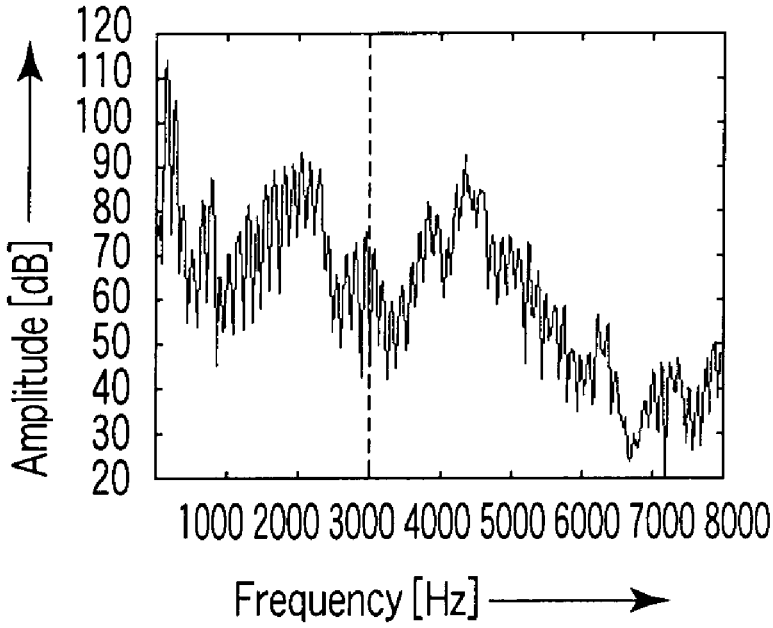
FIG. 5E is a graph showing an example of a deformed spectrum generated by combining the deformed spectrum in FIG. 5C with the spectrum fine structure in FIG. 5D.

A deformed spectrum generating unit 17 receives the deformed spectrum envelope generated by the spectrum envelope deforming unit 15 and the spectrum fine structure extracted by the spectrum fine structure extracting unit 16. The deformed spectrum generating unit 17 generates a deformed spectrum, which is obtained by deforming the speech spectrum of the input speech signal, by combining the deformed spectrum envelope with the spectrum fine structure. If, for example, the deformed spectrum envelope is the one shown in FIG. 5C and the spectrum fine structure is the one shown in FIG. 5D, the deformed spectrum generated by combining them is the one shown in FIG. 5E.

A speech generating unit 18 receives the deformed spectrum generated by the deformed spectrum generating unit 17. The speech generating unit 18 generates an output speech signal digitalized on the basis of the deformed spectrum. A speech output processing unit 19 receives the digital output speech signal. The speech output processing unit 19 converts the output speech signal into an analog signal by using a digital-to-analog converter, and amplifies the signal by using a power amplifier. This unit then supplies the resultant signal to a loudspeaker 20. With this operation, the loudspeaker 20 emits a disrupting sound.

FIGS. 1 and 3 show a case wherein there are one each of the microphone 11 and the loudspeaker 20. However, the number of microphones and the number of loudspeakers may be two or more. In this case, the speech processing apparatus may individually perform processing for each of input speech signals from a plurality of microphones through a plurality of channels and emits disrupting sounds from a plurality of loudspeakers.

Figure 6:
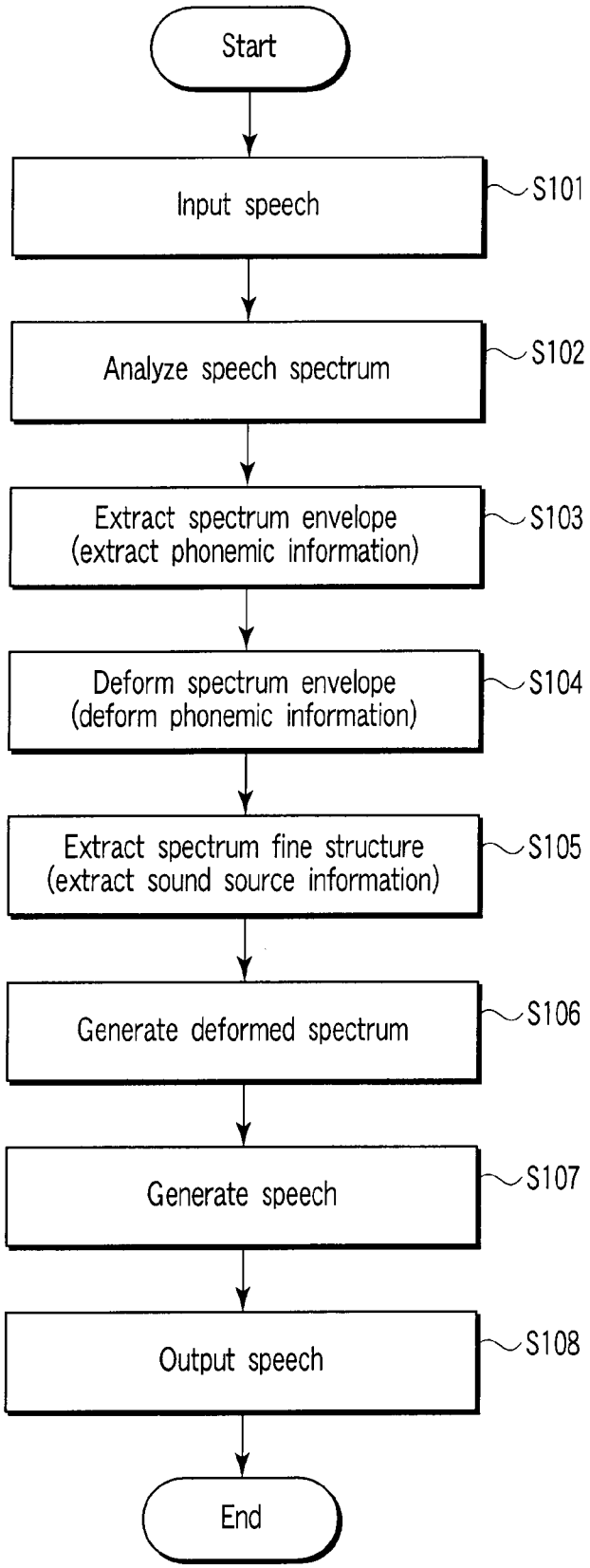
FIG. 6 is a flowchart showing the overall procedure of speech processing in the first embodiment.

The speech processing apparatus 10 shown in FIG. 3 can be implemented by hardware like a digital signal processing apparatus (DSP) but can also be implemented by programs using a computer. A processing procedure to be performed when this processing in the speech processing apparatus 10 is implemented by a computer will be described below with reference to FIG. 6.

The computer performs spectrum analysis (step S102) with respect to an input speech signal input and digitalized in step S101 to extract a spectrum envelope (step S103), and performs spectrum envelope deformation (step S104) and extraction of a spectrum fine structure (step S105) in the above manner. In this case, the order of processing in steps S103, S104, and S105 is arbitrarily set. It suffices to concurrently perform processing in steps S103 and S104 and processing in step S105. The computer generates a deformed spectrum by combining the deformed spectrum envelope generated through steps S103 and S104 with the spectrum fine structure generated in step S105 (step S106). Finally, the computer generates and outputs a speech signal from the deformed spectrum (steps S107 and S108).

A specific example of a spectrum envelope deformation method will be described next. A spectrum envelope is basically deformed by changing the format frequency of a spectrum envelope (i.e., the peak and dip positions of the spectrum envelope). In this case, the purpose of deforming a spectrum envelope is to destroy phonemes. In order to perceive phonemes, it is important to consider the positional relationship between the peaks and dips of a spectrum envelope. For this reason, these peak and dip positions are made different from those before the change. More specifically, this operation can be implemented by deforming a spectrum envelope in at least one of the amplitude direction and the frequency axis direction.

<Spectrum Envelope Deforming Method 1>

Figure 7A:
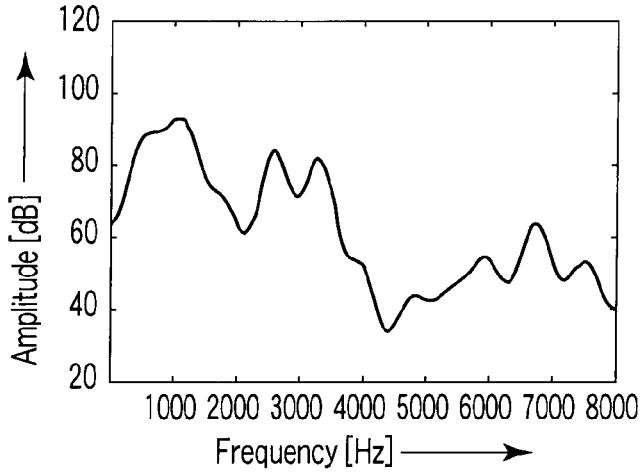
FIG. 7A is a graph showing an example of the spectrum envelope of a speech spectrum.
Figure 7B:
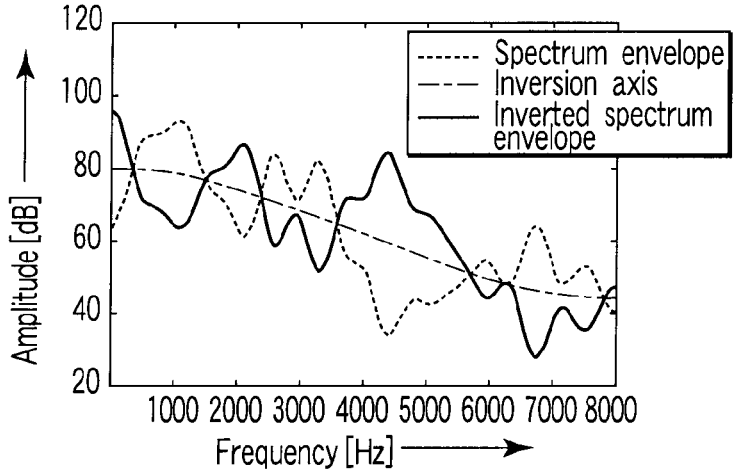
FIG. 7B is a graph for explaining the first example of a method of applying spectrum deformation to a spectrum envelope in the amplitude direction in the first embodiment.
Figure 7C:
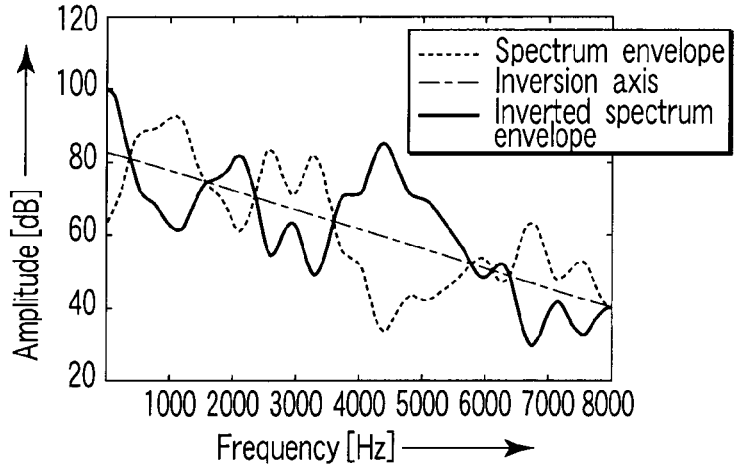
FIG. 7C is a graph for explaining the second example of the method of applying spectrum deformation to a spectrum envelope in the amplitude direction in the first embodiment.
Figure 7D:
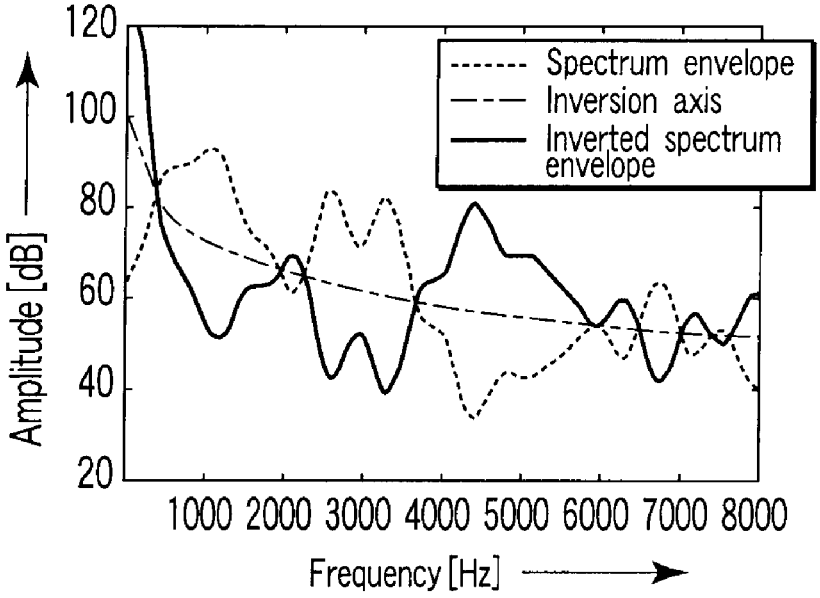
FIG. 7D is a graph for explaining the third example of the method of applying spectrum deformation to a spectrum envelope in the amplitude direction in the first embodiment.
Figure 7E:
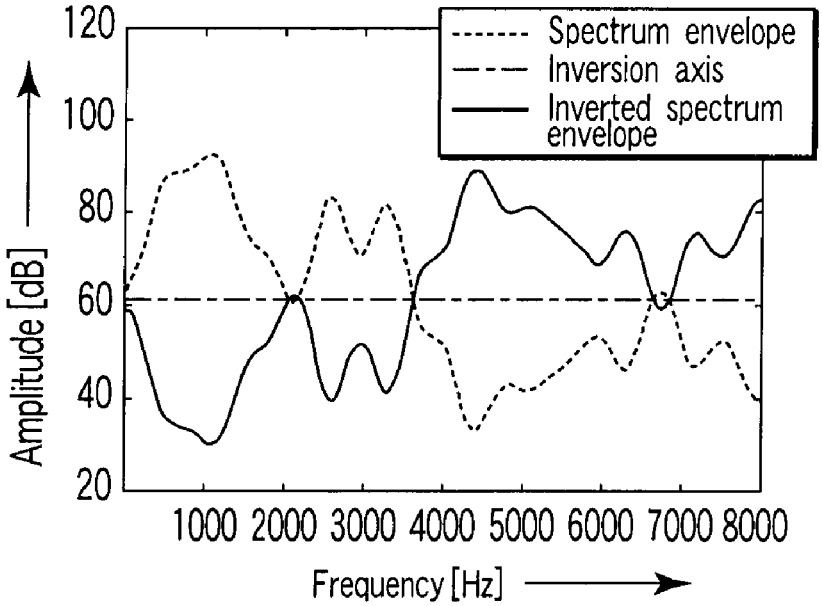
FIG. 7E is a graph for explaining the fourth example of the method of applying spectrum deformation to a spectrum envelope in the amplitude direction in the first embodiment.

FIGS. 7A, 7B, 7C, 7D, and 7E show a technique of changing the positions of peaks and dips by deforming a spectrum envelope in the amplitude direction. In order to deform a spectrum envelope in the amplitude direction, the spectrum envelope deforming unit 15 sets an inversion axis with respect to the spectrum envelope shown in FIG. 7A and inverts the spectrum envelope about the inversion axis. As an inversion axis, one of various kinds of approximation functions can be used. For example, FIG. 7B shows a case wherein an inversion axis is set by a cosine function. FIG. 7C shows a case wherein an inversion axis is set by a straight line. FIG. 7D shows a case wherein an inversion axis is set by a logarithm. FIG. 7E shows a case wherein an inversion axis is set parallel to the average of the amplitudes of the spectrum envelope, i.e., the frequency axis. Obviously, in either of the cases shown in FIGS. 7B, 7C, 7D, and 7E, the positions of peaks and dips (frequency) have changed with respect to those of the original spectrum envelope in FIG. 7A.

<Spectrum Envelope Deforming Method 2>

Figure 8A:
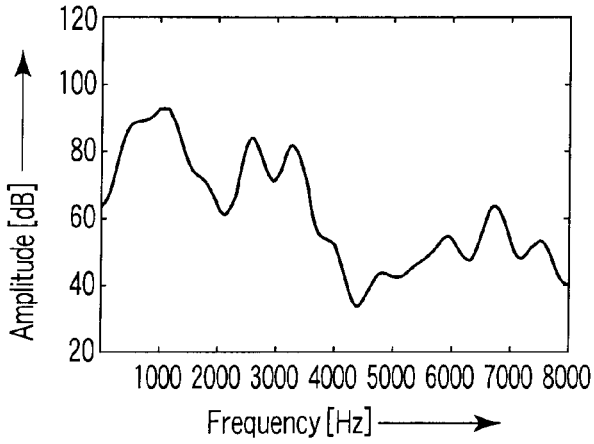
FIG. 8A is a graph showing an example of the spectrum envelope of a speech spectrum.
Figure 8B:
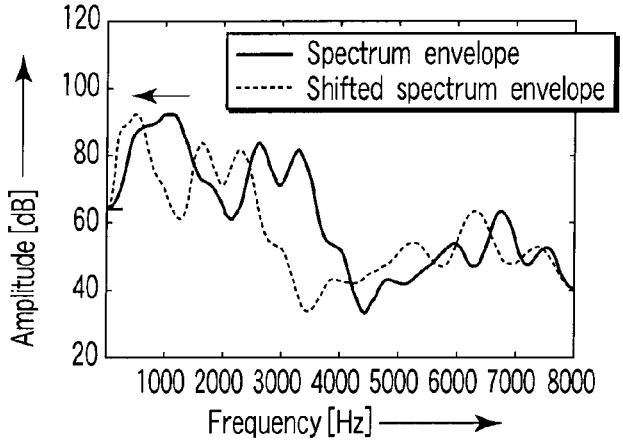
FIG. 8B is a graph for explaining the first example of a method of applying spectrum deformation to a spectrum envelope in the frequency axis direction in the first embodiment.
Figure 8C:
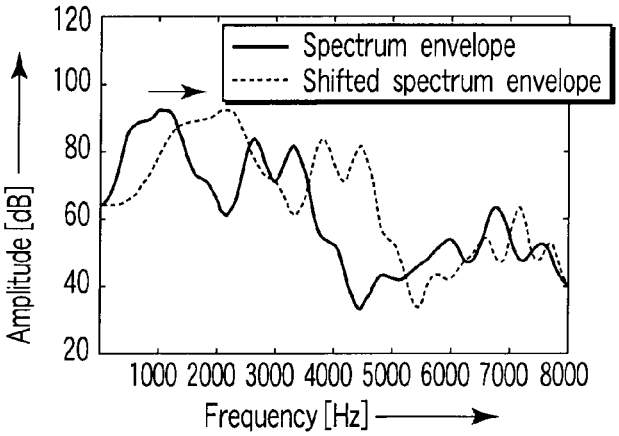
FIG. 8C is a graph for explaining the second example of the method of applying spectrum deformation to a spectrum envelope in the frequency axis direction in the first embodiment.

FIGS. 8A, 8B, and 8C show a technique of changing the positions of peaks and dips by deforming a spectrum envelope in the frequency axis direction. In order to deform a spectrum envelope in the frequency axis direction, the spectrum envelope shown in FIG. 8A is shifted to the low-frequency side as shown in FIG. 8B or to the high-frequency side as shown in FIG. 8C. As a method of deforming a spectrum envelope in the frequency axis direction, there is also conceivable a method of performing a linear warping process or non-linear warping process on the frequency axis. In order to deform a spectrum envelope in the frequency axis direction, it is possible to combine a shifting process and a warping process on the frequency axis. It is not always necessary to perform deformation on the frequency axis throughout the entire band of the spectrum envelope. It suffices to perform such operation for part of the band.

<Spectrum Envelope Deforming Method 3>

Spectral envelope deforming methods 1 and 2 described above perform the processing of deforming the low-frequency component of the spectrum of an input speech signal, and hence are effective for phonemes whose first and second formants exist in a low-frequency range like vowels. However, deformation methods 1 and 2 are little effective for /e/ and /i/ whose second formants exist in a high-frequency range, the fricative sound /s/ which exhibits characteristics in a high-frequency range, the plosive sound /k/, and the like. For this reason, it is preferable to dynamically control a target frequency band in which a spectrum envelope is to be deformed and an inversion axis in accordance with the spectrum shapes of phonemes.

Figure 9A:
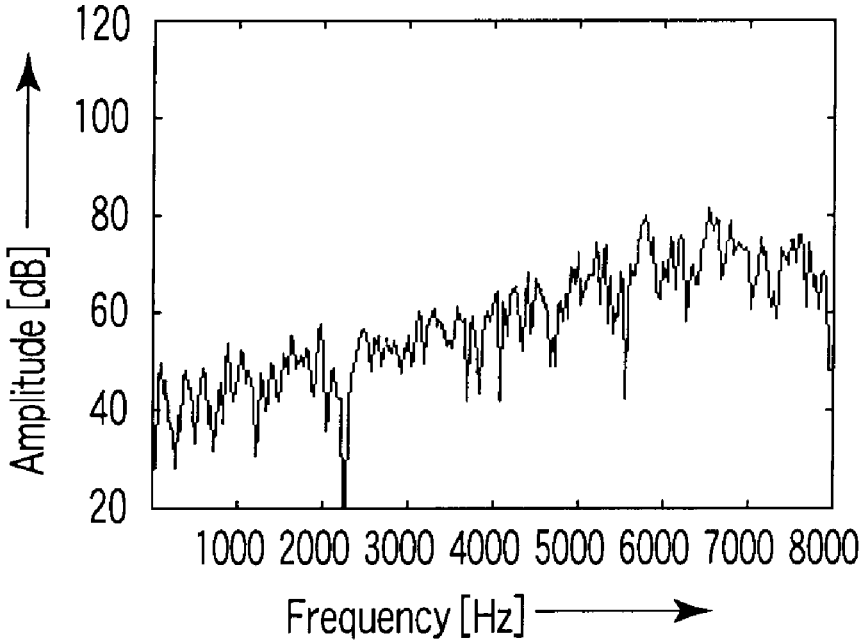
FIG. 9A is a graph showing an example of the spectrum of a fricative sound.
Figure 9B:
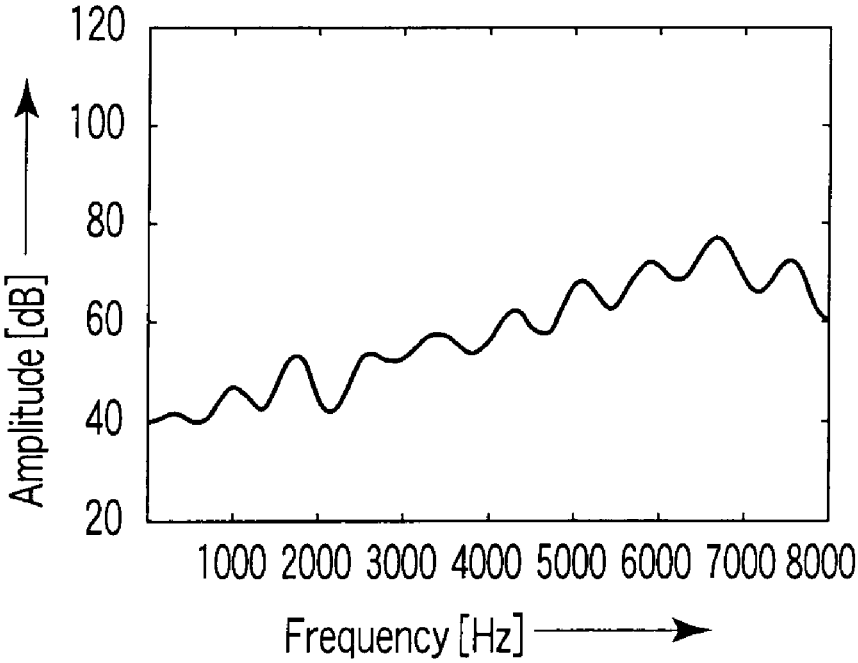
FIG. 9B is a graph showing an example of the spectrum envelope of a fricative sound.
Figure 9C:
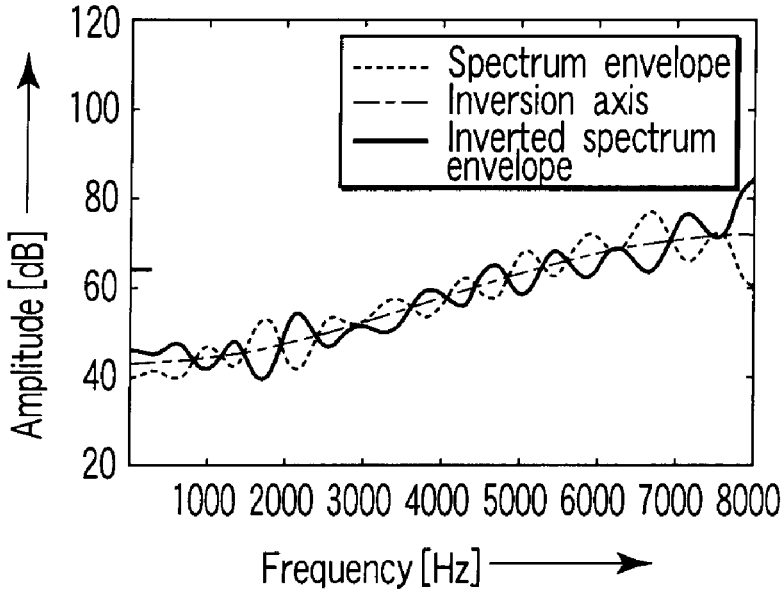
FIG. 9C is a graph for explaining the first example of a method of applying spectrum deformation to the spectrum envelope of a fricative sound in the amplitude direction in the first embodiment.
Figure 9D:
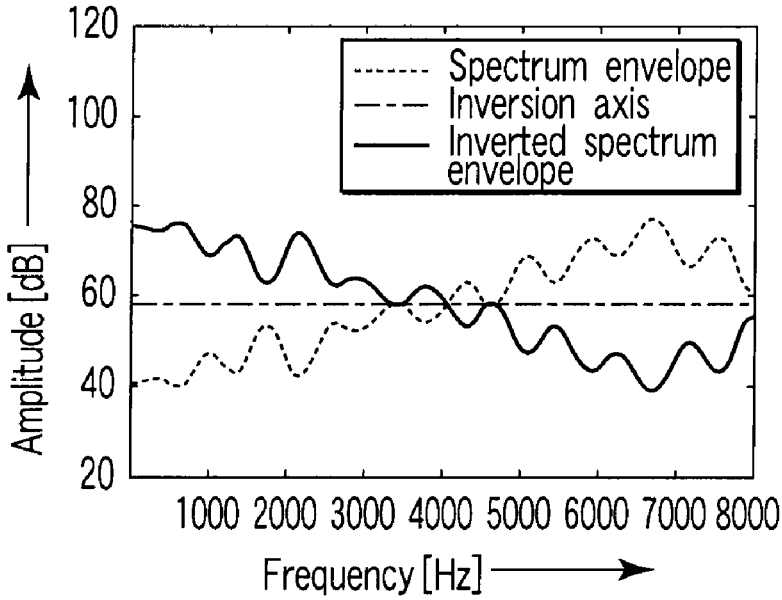
FIG. 9D is a graph for explaining the second example of a method of applying spectrum deformation to the spectrum envelope of a fricative sound in the amplitude direction in the first embodiment.

Consider, for example, phonemes exhibiting characteristics in a high-frequency range like a fricative sound. In this case, even if the positions of peaks and dips of a spectrum envelope are changed, the characteristics of the spectrum envelope hardly change. FIG. 9A shows the spectrum of fricative sound. FIG. 9B shows the spectrum envelope of the fricative sound. If the spectrum envelope in FIG. 9B is inverted about the inversion axis represented by a cosine function as in, for example, FIG. 7B, the spectrum envelope shown in FIG. 9C is obtained. That is, the characteristics of the spectrum envelope change little. In such a case, as shown in, for example, FIG. 9D, inverting the spectrum envelope about the inversion axis set to the average of the amplitudes of the spectrum envelope as in FIG. 7E can noticeably change the characteristics. This is merely an example. That is, any deformation can be used as long as it noticeably changes the characteristics of a spectrum envelope.

As described above, the first embodiment generates a deformed spectrum envelope by deforming the spectrum envelope of an input speech signal, and generates a deformed spectrum by combining the deformed spectrum envelope with the spectrum fine structure of the input speech signal, thereby generating an output speech signal on the basis of the deformed spectrum.

If, therefore, an output speech signal is generated by performing the above processing for the input speech signal obtained by capturing conversational speech using the microphone 11 placed at the position A in FIG. 1, and a disrupting sound in which the phonemic characteristics of the conversational speech are destroyed is output from the loudspeaker 20 placed at the position B by using the output speech signal, the conversational speech becomes obscure to the third party at the position C because the disrupting sound is perceptually fused with the direct sound of the conversational speech. As a result, it becomes difficult for the third party to perceive the contents of conversation.

That is, in a disrupting sound, the phonemic characteristics determined by the shape of a spectrum envelope are destroyed while sound source information which is the spectrum fine structure of the input speech signal based on conversation is maintained. For this reason, the disrupting sound is well fused with the direct sound of conversation. Using such a disrupting sound, therefore, makes it possible to prevent a third party from perceiving the contents of conversational speech without annoying surrounding people, unlike in the case wherein a masking sound like pink noise or BGM is used.

Second Embodiment

Figure 10:
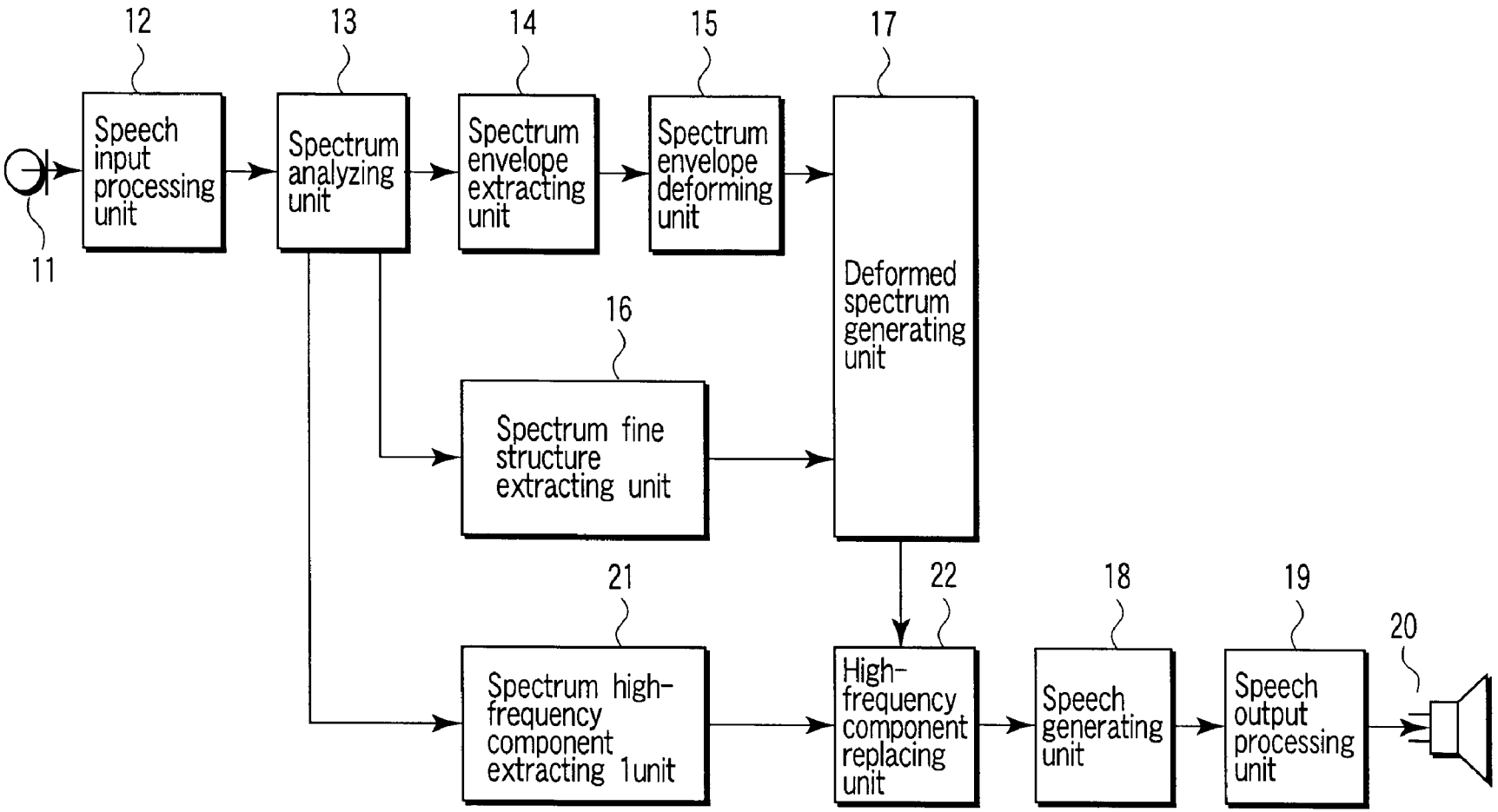
FIG. 10 is a block diagram showing the arrangement of a speech processing apparatus according to the second embodiment of the present invention.

The second embodiment of the present invention will be described next. FIG. 10 shows a speech processing apparatus according to the second embodiment, which is the same as the speech processing apparatus according to the first embodiment shown in FIG. 3 except that it additionally includes a spectrum high-frequency component extracting unit 21 and a high-frequency component replacing unit 22.

The spectrum high-frequency component extracting unit 21 extracts the high-frequency component of the spectrum of an input speech signal through a spectrum analyzing unit 13. The high-frequency component of the spectrum represents individual information, which can be extracted from, for example, the FFT result (the spectrum of the input speech signal) in step S2 in FIG. 4. The high-frequency component replacing unit 22 receives the extracted high-frequency component. The high-frequency component replacing unit 22 is inserted between the output of a deformed spectrum generating unit 17 and the input of a speech generating unit 18, and performs the processing of replacing the high-frequency component in the deformed spectrum generated by the deformed spectrum generating unit 17 with the high-frequency component extracted by the spectrum high-frequency component extracting unit 21. The speech generating unit 18 generates an output speech signal on the basis of the deformed spectrum after the high-frequency component is replaced.

Figure 11:
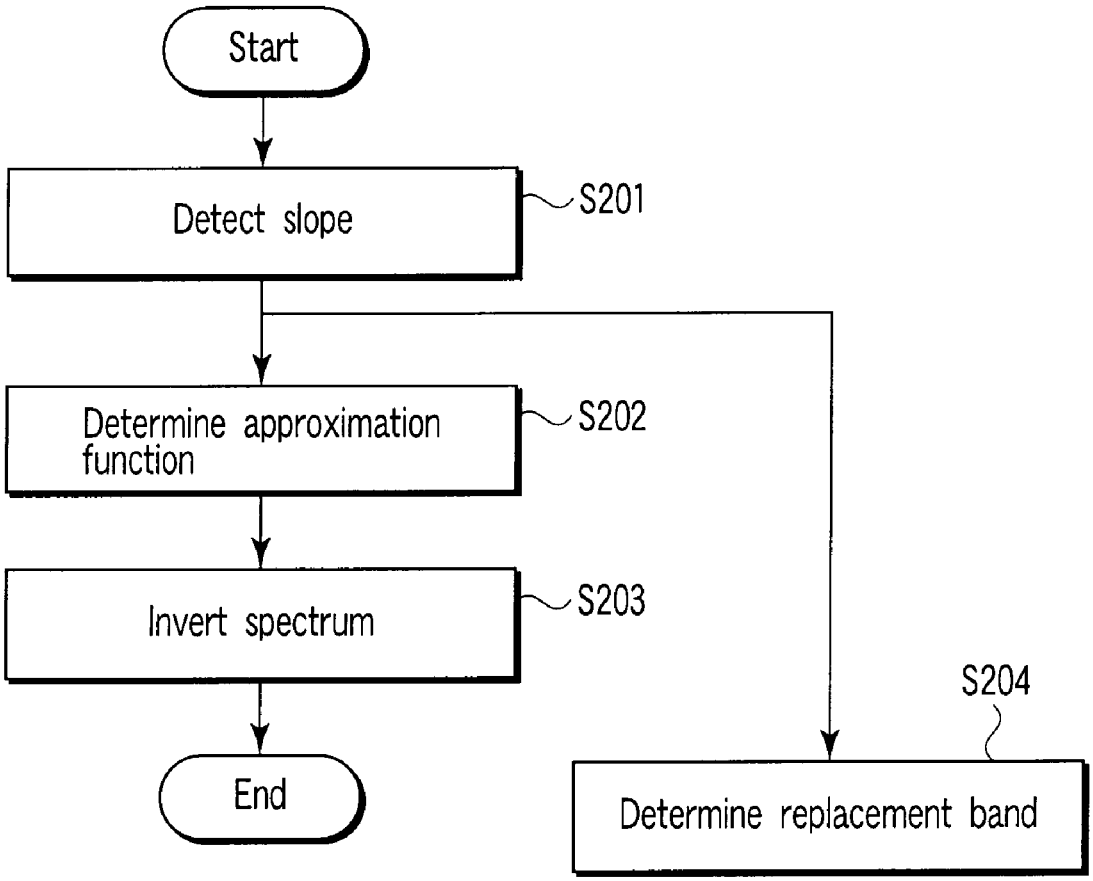
FIG. 11 is a flowchart showing part of processing performed by a spectrum envelope deforming unit and processing performed by a high-frequency component extracting unit according to the second embodiment.

FIG. 11 shows part of the processing to be performed when a spectrum envelope deforming unit 15 performs the spectrum envelope deformation shown in FIGS. 7B, 7C, and 7D and the processing performed by the high-frequency component extracting unit 22. The spectrum envelope deforming unit 15 detects the slope of a spectrum envelope (step S201). The spectrum envelope deforming unit 15 then determines a cosine function or an approximation function such as a linear or logarithmic function on the basis of the slope of the spectrum envelope detected in step S201 (step S202), and inverts the spectrum envelope in accordance with the approximation function (step S203). This processing performed by the spectrum envelope deforming unit 15 is the same as that in the first embodiment.

The high-frequency component replacing unit 22 determines a replacement band from the slope of the spectrum envelope detected in step S201, and replaces the high-frequency component which is a frequency component in the replacement band with the high-frequency component extracted by the spectrum high-frequency component extracting unit 21.

Figure 12A:
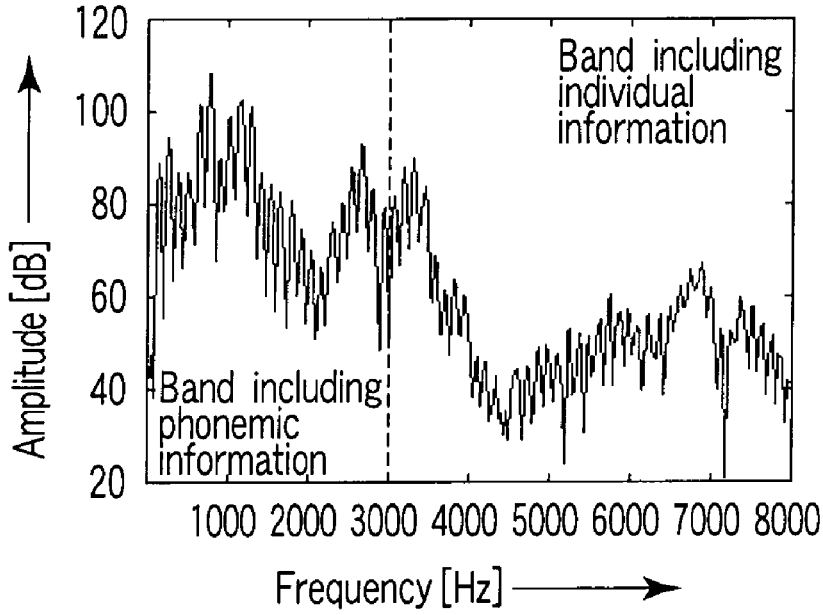
FIG. 12A is a graph showing an example of the speech spectrum of an input speech signal with a strong low-frequency component in FIG. 12A.
Figure 12B:
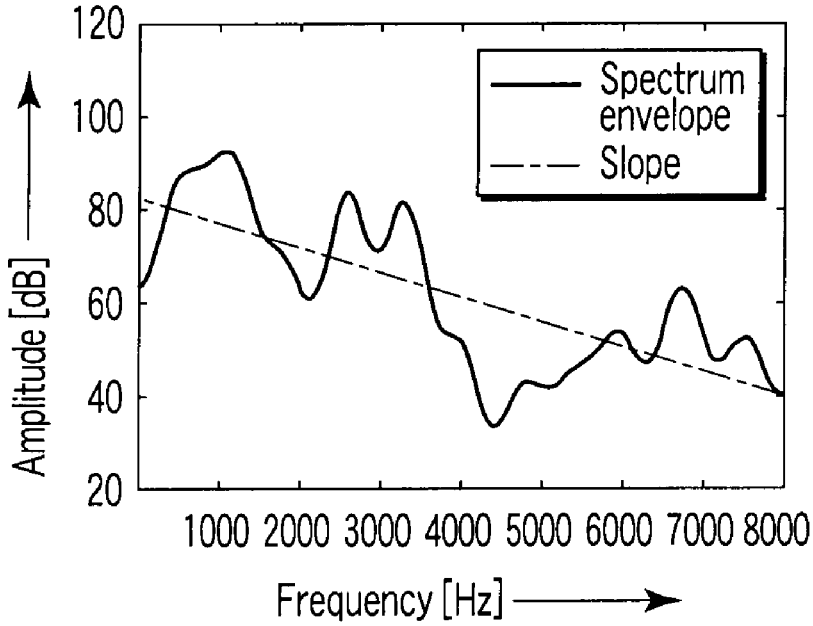
FIG. 12B is a graph showing the spectrum envelope of the speech spectrum in FIG. 12A.

A specific example of processing in the second embodiment will be described next with reference to FIGS. 12A to 12D and 13A to 13D. If, for example, an input speech signal has a spectrum with a strong low-frequency component like a vowel as shown in FIG. 12A, the spectrum envelope of the input speech signal indicates a negative slope as indicated by FIG. 12B. In such a case, the deformed spectrum shown in FIG. 12C is generated by combining the spectrum structure of an input speech signal with the deformed spectrum envelope obtained by inverting a spectrum envelope about an inversion axis conforming to, for example, the above cosine function or an approximation function such as a linear or logarithmic function.

Figure 12C:
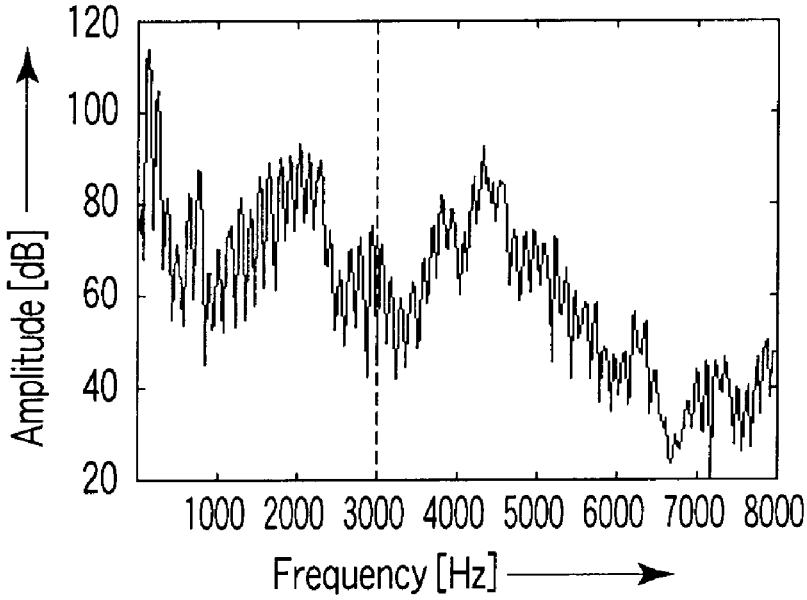
FIG. 12C is a graph showing an example of the deformed spectrum obtained by deforming the speech spectrum in FIG. 12A in the second embodiment.
Figure 12D:
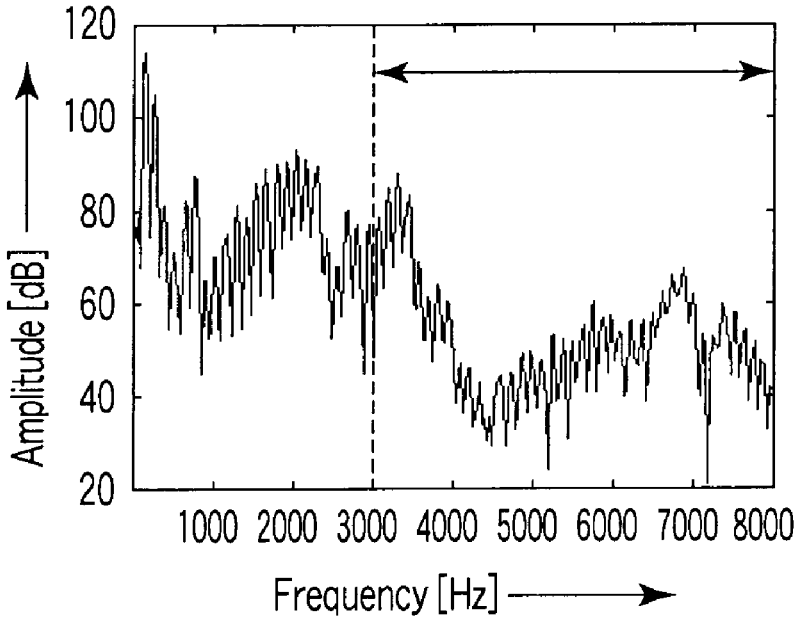
FIG. 12D is a graph showing an example of the spectrum of the disrupting sound generated by replacing the high-frequency component of the deformed spectrum in FIG. 12C in the second embodiment.

A disrupting sound having a spectrum like that shown in FIG. 12D is generated by replacing the high-frequency component (e.g., the frequency component equal to or higher than 3 kHz) of the deformed spectrum in FIG. 12C, which contains individual information, by the high-frequency component of the original speech spectrum in FIG. 12A, with the low-frequency component (e.g., the frequency component equal to or lower than 2.5 to 3 kHz) containing phonemic information being unchanged. In this case, it is conceivable to change the lower limit frequency of a replacement band in accordance with the positions of dips of a spectrum envelope. This makes it possible to determine a band including individual information regardless of the sex or voice quality of a speaker.

Figure 13A:
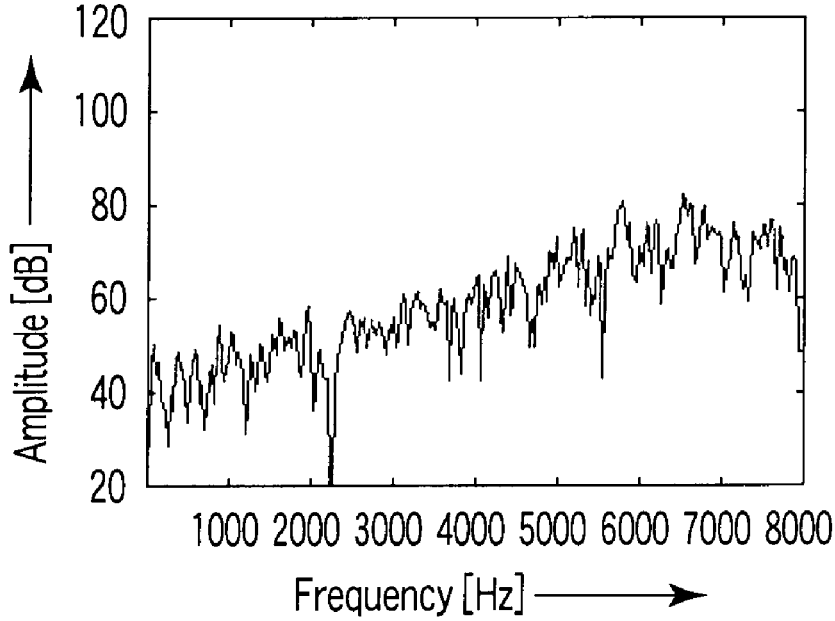
FIG. 13A is a graph showing an example of the speech spectrum of an input speech signal with a strong high-frequency component.
Figure 13B:
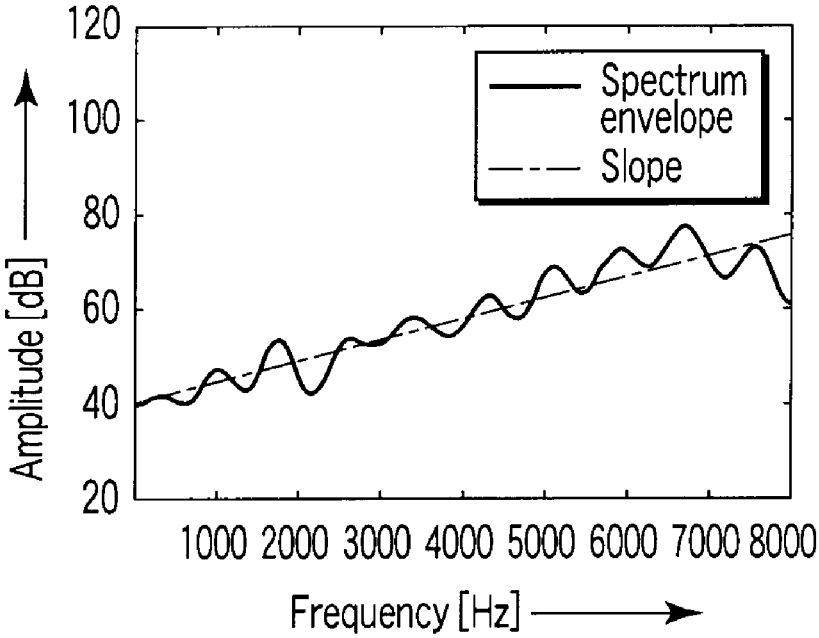
FIG. 13B is a graph showing the spectrum envelope of the speech spectrum in FIG. 13A.

If an input speech signal has a spectrum with a strong high-frequency component like a fricative sound or plosive sound as shown in FIG. 13A, the spectrum envelope of the input speech signal indicates a positive slope as shown in FIG. 13B. In such a case, the deformed spectrum shown in FIG. 13C is generated by, for example, combining the spectrum fine structure of an input speech signal with the deformed spectrum envelope obtained by inverting the spectrum envelope about an inversion axis set to the average of the amplitudes of the spectrum envelope as described above.

Figure 13C:
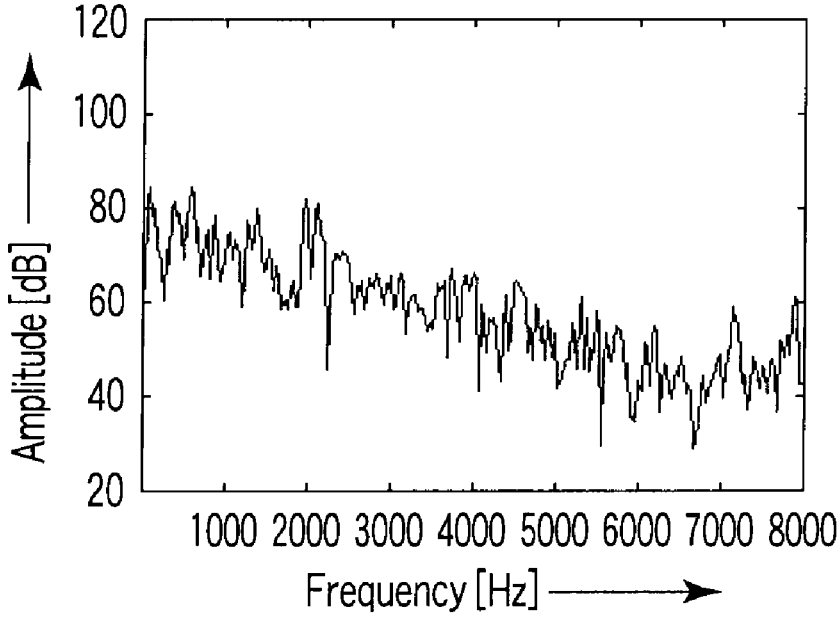
FIG. 13C is a graph showing an example of the deformed spectrum obtained by deforming the speech spectrum in FIG. 13A in the second embodiment.
Figure 13D:
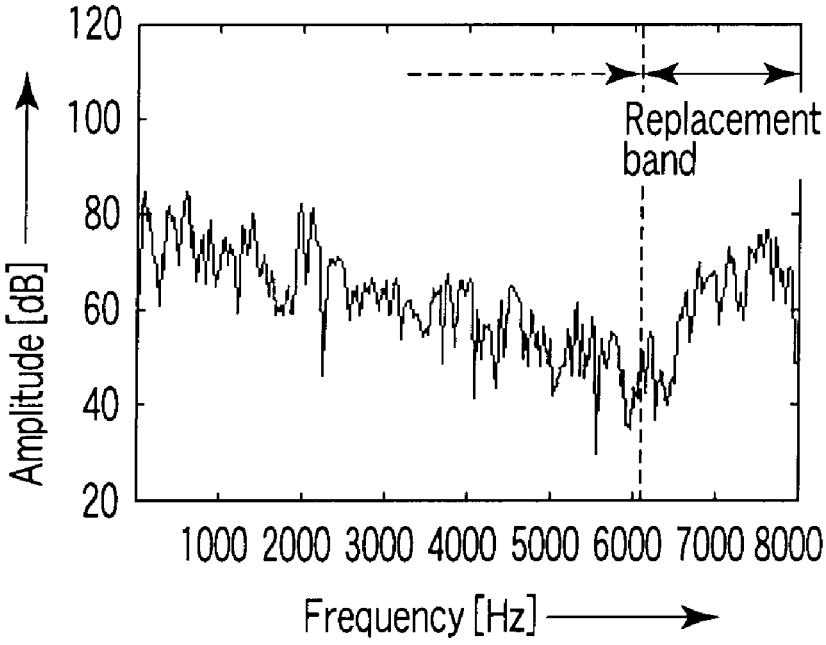
FIG. 13D is a graph showing an example of the spectrum of the disrupting sound generated by replacing the high-frequency component of the deformed spectrum in FIG. 13C in the second embodiment.

A disrupting sound having a spectrum like that shown in FIG. 12D is generated by replacing the high-frequency component of the deformed spectrum in FIG. 13C which contains individual information by the high-frequency component of the original speech spectrum in FIG. 13A, with the low-frequency component of the deformed spectrum which contains phonemic information being unchanged. In the case of a fricative sound or the like, however, since the high-frequency component of the spectrum of the input speech signal is very strong, a replacement band is set on a higher-frequency side, e.g., to a frequency band equal to or more than 6 kHz. In this case, it is possible to change the lower limit frequency of a replacement band in accordance with the positions of peaks of a spectrum envelope. This makes it possible to determine a band including individual information regardless of the sex or voice quality of a speaker.

The speech processing apparatus shown in FIG. 10 can be implemented by hardware like a DSP but can also be implemented by programs using a computer. In addition, the present invention can provide a storage medium storing the programs.

Figure 14:
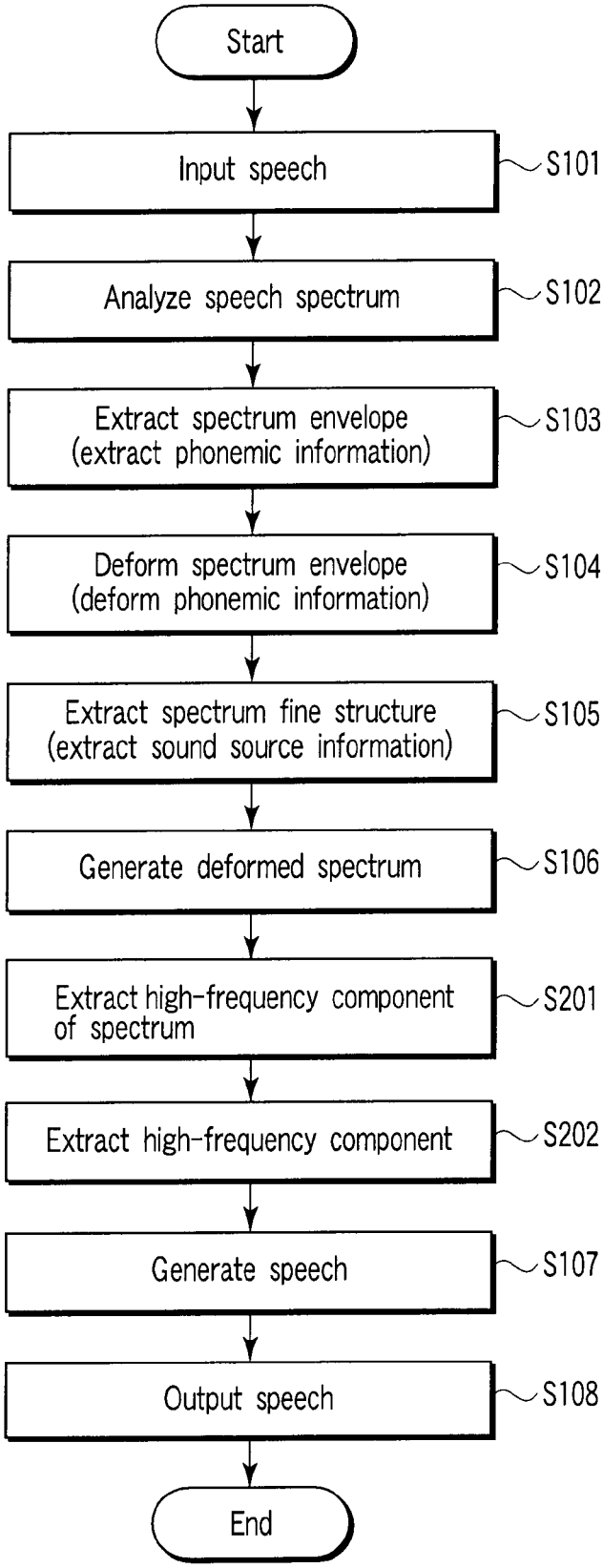
FIG. 14 is a flowchart showing the overall procedure of speech processing in the second embodiment.

A processing procedure to be performed when a computer implements processing in the speech processing apparatus will be described below with reference to FIG. 14. The processing from step S101 to step S106 is the same as that in the first embodiment. In the second embodiment, after generating a deformed spectrum in step S106, the computer extracts the high-frequency component of the spectrum (step S109) and replaces the high-frequency component (step S110). The computer then generates a speech signal from the deformed spectrum after high-frequency component replacement and outputs the speech signal (steps S107 and S108). In this case, the order of processing in steps S103 to S105 and step S109 is arbitrarily set. It suffices to concurrently perform processing in steps S103 and S104 and processing in step S105 or processing in step S109.

As described above, the second embodiment generates an output speech signal by using the deformed spectrum obtained by replacing the high-frequency component of the deformed spectrum generated by combining a deformed spectrum envelope and a spectrum fine structure by the high-frequency component of an input speech signal. This can therefore generate a disrupting sound with the phonemic characteristics of conversational speech being destroyed by the deformation of the spectrum envelope and individual information which is the high-frequency component of the spectrum of the conversational speech being maintained. That is, the inversion of a spectrum envelope can prevent a deterioration in sound quality due to an increase in the high-frequency power of a disrupting sound. In addition, the above operation prevents a situation in which destroying the individual information of conversational speech in a disrupting sound will lead to an insufficient effect of the fusion of the disrupting sound with the conversational speech. This makes it possible to further enhance the effect of preventing a third party from eavesdropping on a conversational speech without annoying surrounding people.

The second embodiment generates a deformed spectrum by combining a deformed spectrum envelope with a spectrum fine structure, and then generates a deformed spectrum with the high-frequency component being replaced. However, even selectively deforming a spectrum envelope with respect to a component in a frequency band other than a high-frequency component (e.g., a low-frequency component and an intermediate-frequency component) can obtain the same effect as that described above.

As has been described above, according to the forms of the present invention, an output speech signal can be generated from an input speech signal based on conversational speech, with the phonemic characteristics being destroyed by the deformation of the spectrum envelope. Therefore, emitting a disrupting sound by using this output speech signal makes it possible to prevent a third party from eavesdropping on a conversational speech. That is, this technique is effective for security protection and privacy protection.

That is, according to the forms of the present invention, since an output speech signal is generated from the deformed spectrum obtained by combining a deformed spectrum envelope with the spectrum fine structure of an input speech signal, the sound source information of a speaker is maintained, and the original conversation is perceptually fused with a disrupting sound even against the auditory characteristics of a human, called the cocktail party effect. This makes conversational speech obscure to a third party and makes it difficult for the third party to catch the conversation. This can therefore protect the secrecy and privacy of a conversational speech.

In this case, it is not necessary to increase the level of a disrupting sound unlike the conventional method using a masking sound. This therefore reduces the situation of annoying surrounding people. In addition, replacing the high-frequency component contained in a deformed spectrum by the high-frequency component of the spectrum of an input speech signal makes it possible to reserve the individual information of conversational speech in a disrupting sound, thus further enhancing the effect of the fusion of conversational speech with the disrupting sound.

The present invention can be used for a technique of preventing a third party from eavesdropping on a conversation or on someone talking on a cellular phone or telephone in general.

What is claimed is:

1. A speech processing method comprising:

extracting a spectrum envelope of an input speech signal;

extracting a spectrum fine structure of the input speech signal for representing the sound source information of the input speech signal;

generating a deformed spectrum envelope by applying deformation to the spectrum envelope upon setting an inversion axis with respect to the spectrum envelope and inverting the spectrum envelope about the inversion axis;

generating a deformed spectrum by combining the deformed spectrum envelope with the spectrum fine structure; and generating an output speech signal on the basis of the deformed spectrum.

2. A speech processing method comprising:

extracting a spectrum envelope of an input speech signal;

extracting a spectrum fine structure of the input speech signal;

generating a deformed spectrum envelope by applying deformation to the spectrum envelope;

generating a deformed spectrum by combining the deformed spectrum envelope with the spectrum fine structure;

extracting a high-frequency component of the spectrum of the input speech signal;

replacing a high-frequency component contained in the deformed spectrum by the extracted high-frequency component; and generating an output speech signal on the basis of a deformed spectrum after replacement of the high-frequency component.

3. A speech processing apparatus comprising:

a spectrum envelope extracting unit which extracts a spectrum envelope of an input speech signal;

a spectrum fine structure extracting unit which extracts a spectrum fine structure of the input speech signal;

a spectrum envelope deforming unit which applies deformation to the spectrum envelope upon setting an inversion axis with respect to the spectrum envelope and inverting the spectrum envelope about the inversion axis to generate a deformed spectrum envelope;

a deformed spectrum generating unit which generates a deformed spectrum by combining the deformed spectrum envelope with the spectrum fine structure; and a speech generating unit which generates an output speech signal on the basis of the deformed spectrum.

4. A speech processing apparatus according to claim 3, wherein the spectrum envelope deforming unit is configured to apply the deformation to the spectrum envelope in at least one of an amplitude direction and a frequency axis direction.

5. A speech processing apparatus according to claim 3, wherein the spectrum envelope deforming unit is configured to apply the deformation by changing positions of peaks and dips of the spectrum envelope.

6. A speech processing apparatus according to claim 3, wherein the spectrum envelope deforming unit is configured to apply the deformation by shifting the spectrum envelope on a frequency axis.

7. A speech system comprising:

a microphone which captures conversational speech to obtain the input speech signal;

a speech processing apparatus defined in claim 3; and a loudspeaker which emits a disrupting sound in accordance with the output speech signal.

8. A speech processing apparatus comprising:

a spectrum envelope extracting unit which extracts a spectrum envelope of an input speech signal;

a spectrum fine structure extracting unit which extracts a spectrum fine structure of the input speech signal;

a spectrum envelope deforming unit which applies deformation to the spectrum envelope to generate a deformed spectrum envelope;

a deformed spectrum generating unit which generates a deformed spectrum by combining the deformed spectrum envelope with the spectrum fine structure;

a high-frequency component extracting unit which extracts a high-frequency component of the spectrum of the input speech signal;

a high-frequency component replacing unit which replaces a high-frequency component contained in the deformed spectrum by the high-frequency component extracted by the high-frequency extracting unit; and a speech generating unit which generates an output speech signal on the basis of a deformed spectrum after replacement of the high-frequency component.

9. A speech processing apparatus according to claim 8, wherein the spectrum envelope deforming unit is configured to apply the deformation to the spectrum envelope in at least one of an amplitude direction and a frequency axis direction.

10. A speech processing apparatus according to claim 8, wherein the spectrum envelope deforming unit is configured to apply the deformation by changing positions of peaks and dips of the spectrum envelope.

11. A speech processing apparatus according to claim 8, wherein the spectrum envelope deforming unit is configured to apply the deformation by setting an inversion axis with respect to the spectrum envelope and inverting the spectrum envelope about the inversion axis.

12. A speech processing apparatus according to claim 8, wherein the spectrum envelope deforming unit is configured to apply the deformation by shifting the spectrum envelope on a frequency axis.

13. A speech processing apparatus according to claim 8, wherein the high-frequency component replacing unit sets a replacement band with respect to a high-frequency component extracted by the high-frequency component extracting unit and replaces the high-frequency component contained in the deformed spectrum by a high-frequency component in the replacement band.

14. A speech system comprising:

a microphone which captures conversational speech to obtain the input speech signal;

a speech processing apparatus according to claim 8; and a loudspeaker which emits a disrupting sound in accordance with the output speech signal.

15. A computer readable storage medium storing instructions of a computer program which when executed by a computer results in performance of steps comprising:

extracting a spectrum envelope of an input speech signal;

extracting a spectrum fine structure of the input speech signal;

generating a deformed spectrum envelope by applying deformation to the spectrum envelope upon setting an inversion axis with respect to the spectrum envelope and inverting the spectrum envelope about the inversion axis;

generating a deformed spectrum by combining the deformed spectrum envelope with the spectrum fine structure; and generating an output speech signal on the basis of the deformed spectrum.

16. A computer readable storage medium storing instructions of a computer program which when executed by a computer results in performance of steps comprising:

extracting a spectrum envelope of an input speech signal;

extracting a spectrum fine structure of the input speech signal;

generating a deformed spectrum envelope by applying deformation to the spectrum envelope;

generating a deformed spectrum by combining the deformed spectrum envelope with the spectrum fine structure;

extracting a high-frequency component of the spectrum of the input speech signal;

replacing a high-frequency component contained in the deformed spectrum by the extracted high-frequency component; and generating an output speech signal on the basis of a deformed spectrum after replacement of the high-frequency component.

* * * * *